US012302956B2

(12) United States Patent
Ben

(10) Patent No.: US 12,302,956 B2
(45) Date of Patent: May 20, 2025

(54) ADJUSTABLE DOUBLE PADDED BRA HAVING A FIXATION MECHANISM

(71) Applicant: Samantha Ben, Fort Lee, NJ (US)

(72) Inventor: Samantha Ben, Fort Lee, NJ (US)

( * ) Notice: Subject to any disclaimer, the term of this patent is extended or adjusted under 35 U.S.C. 154(b) by 0 days.

(21) Appl. No.: 18/232,373

(22) Filed: Aug. 10, 2023

(65) Prior Publication Data

US 2024/0049807 A1 Feb. 15, 2024

Related U.S. Application Data

(60) Provisional application No. 63/396,641, filed on Aug. 10, 2022.

(51) Int. Cl.
*A41C 3/00* (2006.01)

(52) U.S. Cl.
CPC ..... *A41C 3/0028* (2013.01)

(58) Field of Classification Search
CPC ..... A41C 3/0028
USPC ..... 450/55
See application file for complete search history.

(56) References Cited

U.S. PATENT DOCUMENTS 6,994,606 B2 * 2/2006 Li ..... A41F 15/002 450/82
7,001,240 B1 * 2/2006 Huffman-Jimenez ..... A41F 1/006 450/60
7,232,359 B1 * 6/2007 Richardson ..... A41C 3/0028 450/86
8,177,602 B1 * 5/2012 Kaytes ..... A41C 3/0028 450/60
8,425,274 B1 * 4/2013 Ratcliff ..... A44C 5/00 450/86
10,856,586 B2 * 12/2020 Hirakubo ..... A41C 3/142
11,871,801 B1 * 1/2024 Ratcliff ..... A44C 15/009
2006/0228988 A1 * 10/2006 Weyenberg ..... A41C 3/0028 450/58
2010/0130098 A1 * 5/2010 Kammerer ..... A41C 3/02 450/39
2012/0135667 A1 * 5/2012 Chan ..... A41C 3/0092 450/86
2014/0213146 A1 * 7/2014 Chen ..... A41C 3/065 450/1
2016/0157528 A1 * 6/2016 Hoeven ..... A41C 3/0028 450/71
2016/0338420 A1 * 11/2016 Betts ..... A41C 3/0035

* cited by examiner

*Primary Examiner* — Gloria M Hale
(74) *Attorney, Agent, or Firm* — Gearhart Law, LLC

(57) ABSTRACT

An adjustable double padded bra having a resizable front gore component and includes, at least, a first cup affixed between a first strap and a first wing and a second cup affixed between a second strap and a second wing. The first wing is affixed to the second wing via a fixation mechanism. The double padded bra also includes a resizable front gore component disposed between the first cup and the second cup. The resizable front gore component is configured to adjust a length between the first cup and the second cup to increase or decrease an amount of cleavage for the user wearing the double padded bra.

11 Claims, 3 Drawing Sheets

ADJUSTABLE DOUBLE PADDED BRA HAVING A FIXATION MECHANISM

CROSS REFERENCE

This application is a U.S. Non-Provisional Utility application entitled, "ADJUSTABLE DOUBLE PADDED BRA HAVING A RESIZABLE FRONT GORE COMPONENT" which claims benefits from U.S. Provisional Utility entitled, "DOUBLE PADDED BRA" Application No. 63/396,641 filed Aug. 10, 2022.

FIELD OF THE EMBODIMENTS

The field of the invention and its embodiments relate to a double padded bra that allows a user/wearer to easily achieve a desired amount of cleavage and to adjust the amount of cleavage.

BACKGROUND OF THE EMBODIMENTS

Bras have been available for many years in numerous forms. As one example, a push up bra is aimed at enhancing cleavage of the wearer. However, push up bras only allow for the cleavage of the wearer to be enhanced to a certain amount. As such, if the wearer wishes to achieve either an enhanced or reduced level of cleavage from the amount of cleavage achieved by a given push up bra, the wearer purchases numerous bras to do so. Thus, what is needed is a bra that allows the wearer to easily achieve a desired amount of cleavage and to adjust the amount of cleavage.

REVIEW OF RELATED TECHNOLOGY

U.S. Pat. No. 3,814,107A describes a padded type brassiere has a pair of padded bust-supporting cups, a longitudinally resilient under-bust, body encircling band, a pair of resilient shoulder straps secured to the outer side-portion of the bust cups, and a pair of resilient gussets secured to the upper outer quadrants of the bust cups and the adjacent shoulder straps. The gussets flex in response to tension applied to the shoulder straps to maintain the bust cups in a relatively fixed position in relation to the under-bust band. The bust cups have a pad of soft fibrous material integral therewith, each forming a shelf along a generally diagonal line of the cup to push the bust of the wearer upwardly and inwardly of its normal unsupported position.

US20090061731A1 describes an adjustable breast positioning system for a breast received within a breast cup of a woman's garment comprising a platform situated within a lower region of the breast cup; a shaping member at least partially overlaying the platform wherein the platform and shaping member are open to the top portion of the breast cup; and a connector having one end coupled to the platform and another end connected to an anchor moveably mounted to the garment for adjusting the platform for reducing the available volume for the breast within the breast cup and for concomitantly pushing the shaping member upward and inward for displacing the breast upward, forward, and inward toward the center of the wearer's chest while simultaneously increasing the volume of the breast outside the top portion of the breast cup for providing a more desirable visual presentation of the breast.

CN20967738U describes a bra with side pushing and massaging functions, which comprises a breast platform, two cups, two shoulder straps and two side wings, the two cups are arranged on the breast platform in a bilateral symmetry manner, and two side edges of the breast platform are respectively connected to the two side wings; one end of each shoulder strap is connected to the corresponding cup, and the other end of each shoulder strap is connected to the corresponding side wing; massage pieces are further arranged on the portions, close to the side wings, of the back faces of the two cups respectively, each massage piece is of a 3D soft bead massage cotton structure, and a plurality of 3D soft bead protrusions are arranged on the sides, back to the cups, of the massage pieces. The bra disclosed by the utility model has a better massage effect while having the effect of laterally pushing and gathering, and is comfortable to wear and skin-friendly.

JP09157911A describes a bra that enables the lifting up breasts and pushing the breasts close to the center to emphasize the cleavage between them by burying wires along the lower edges of the cups and the prevention of giving pains on the bust by both the ends of the wires.

TWM454733U describes a bra with lifting girdles. Each lifting of girdles with one end near the outer edge of the cup is connected with the upper end of the, other is connected with one end of the inner edge of the cup, and high internal outside assumes low and inclined. Inclined support with trouser waist of the user with the lower edge of the outer edge of the breast, the breast to generate upward supporting role, the role and pushing inwards collection chest, lifting breast fullness, and aesthetic feeling of the lifting column.

TWM348491U describes a bra with a pad that provides a push-up and push-in effect.

TWM300043U describes a bra that has a liner that provides a upward and centering effect.

Various similar bras exist in the art. However, their means of operation are substantially different from the present disclosure, as the other inventions fail to solve all the problems taught by the present disclosure.

SUMMARY OF THE EMBODIMENTS

The present invention and its embodiments relate to a double padded bra that allows a user/wearer to easily achieve a desired amount of cleavage and to adjust the amount of cleavage.

The double padded bra of the instant invention includes, at least, a first cup affixed between a first strap and a first wing and a second cup affixed between a second strap and a second wing. The first wing is affixed to the second wing via a fixation mechanism. The double padded bra also includes a resizable front gore component disposed between the first cup and the second cup. The resizable front gore component is configured to adjust a length between the first cup and the second cup to increase or decrease an amount of cleavage for the user wearing the double padded bra.

In some examples, each of the first cup and the second cup are padded. In other examples, each of the first cup and the second cup are non-padded. Moreover, in some examples, the resizable front gore component comprises a first securement portion, a second securement portion, and a resizing component. Each of the first securement portion and the second securement portion comprise hooks and the resizing component comprises a slider component to adjust the length between the first cup and the second cup.

In other examples, the double padded bra also includes a first receiving portion affixed to an exterior side of the first cup and a second receiving portion affixed to an exterior side of the second cup. Each of the first receiving portion and the second receiving portion comprise a loop or an opening. The first receiving portion is configured to receive a first securement portion of the resizable front gore component. The second receiving portion is configured to receive a second securement portion of the resizable front gore component.

In additional examples, the resizable front gore component may be affixed directly to an exterior of the first cup and to the exterior of the second cup via a fixation means. The fixation means may be: an adhesive, a hook-and-loop fastener, or a sew-on fastener component, among others.

In some examples, an upper cup area of the first cup and an upper cup area of the second cup comprises a plurality of openings. In this configuration, the resizable front gore component comprises a piece of fabric such that the piece of fabric is woven through the plurality of openings and is secured when a user achieves a desired length of the resizable front gore component.

In another example, the resizable front gore component comprises a piece of fabric that is configured to be looped through a first receiving portion affixed to an exterior side of the first cup and a second receiving portion affixed to an exterior side of the second cup and secured when a user achieves a desired length of the resizable front gore component.

DESCRIPTION OF THE PREFERRED EMBODIMENTS

Figure 1:
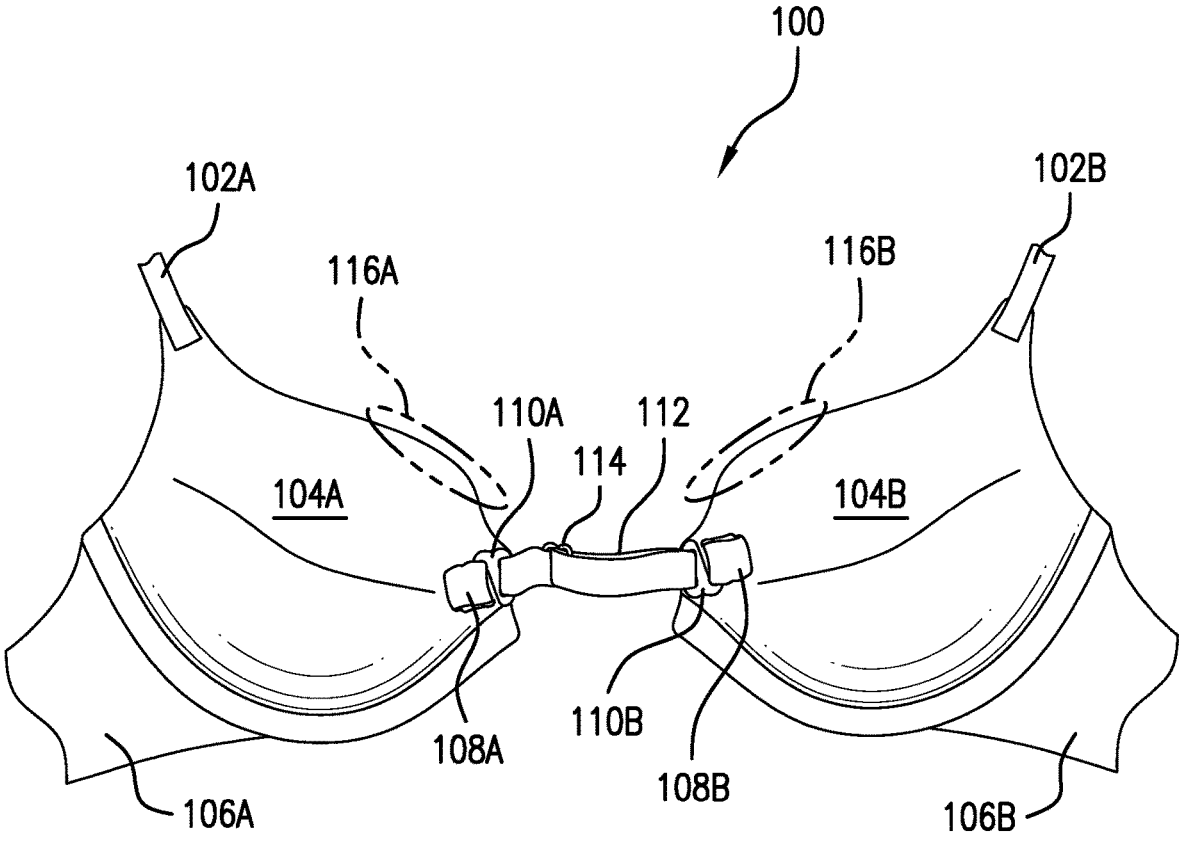
FIG. 1 depicts a perspective view of a double padded bra, in accordance with embodiments of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Figure 2:
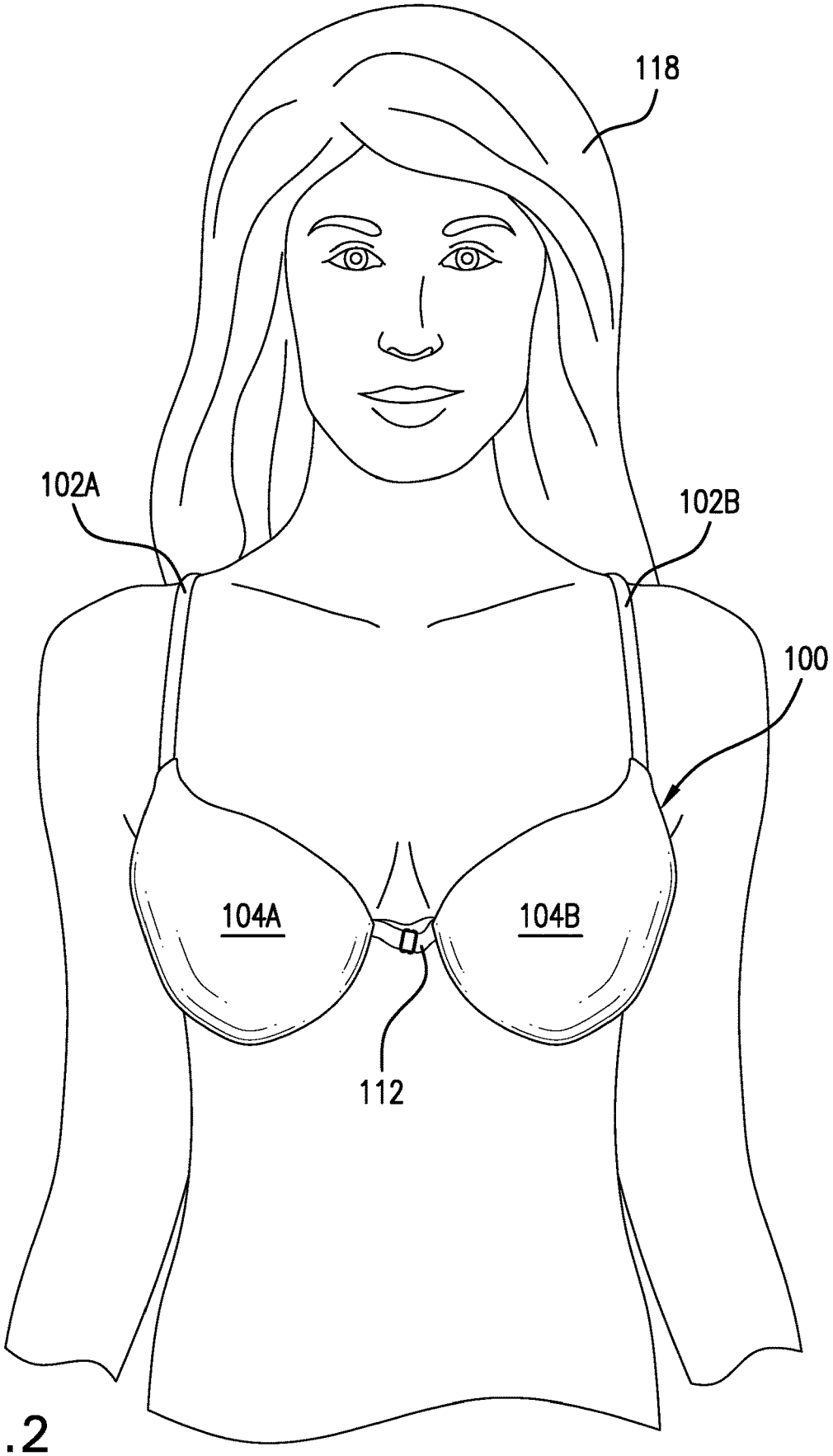
FIG. 2 depicts a perspective view of a double padded bra prior to the user/wearer achieving a desired cleavage level, in accordance with embodiments of the present invention.
Figure 3:
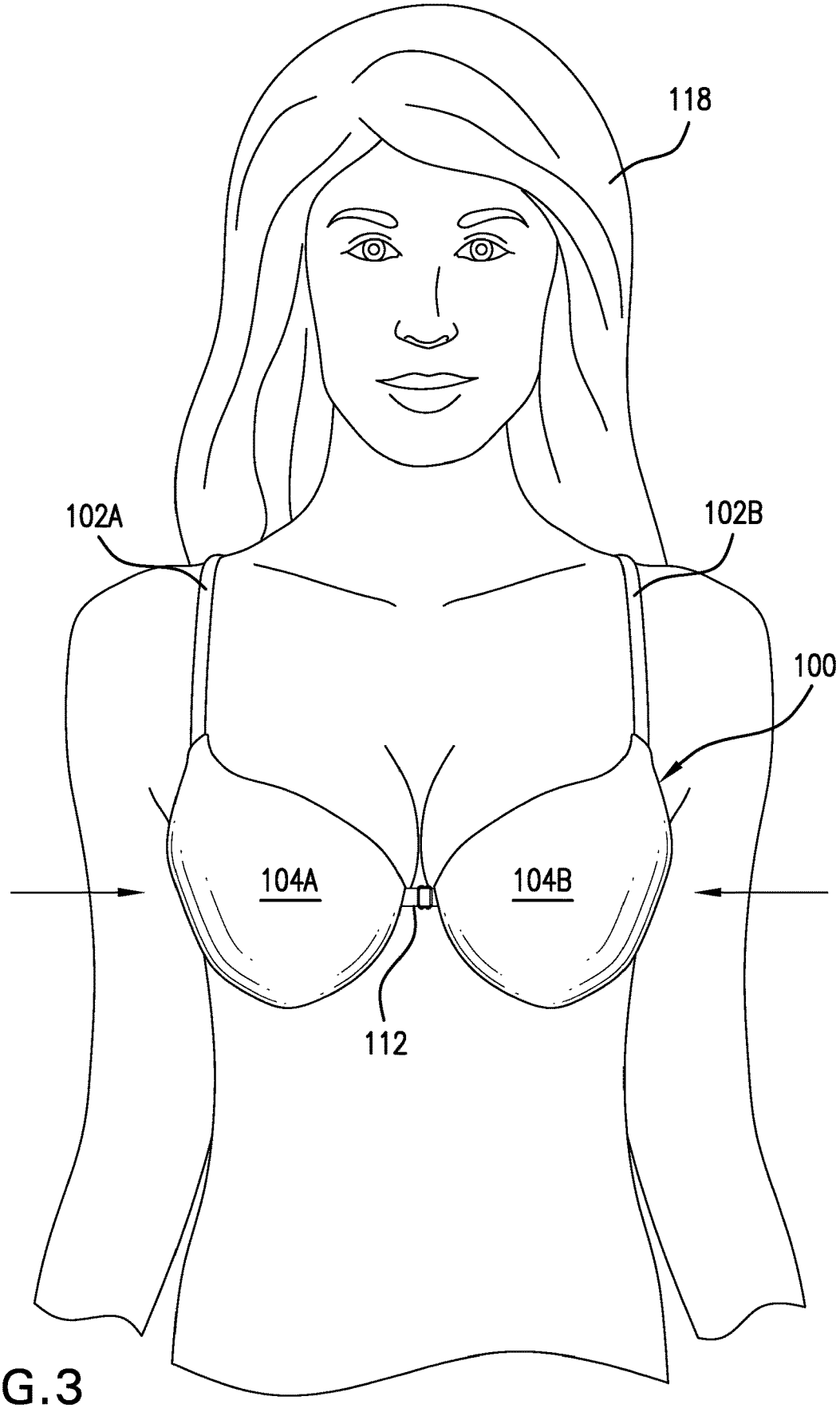
FIG. 3 depicts a perspective view of a double padded bra after the user/wearer achieves the desired cleavage level, in accordance with embodiments of the present invention.

As shown in FIG. 1, FIG. 2, and FIG. 3, the present invention describes a double padded bra 100 that allows a user/wearer 118 to easily achieve a desired amount of cleavage and to adjust the amount of cleavage. As shown in FIG. 1, the double padded bra 100 includes several components, such as: a first cup 104A and a second cup 104B. In some examples, each of the first cup 104A and the second cup 104B are padded. In other examples, each of the first cup 104A and the second cup 104B are non-padded.

The double padded bra 100 also includes a resizable front gore component 112, a first strap 102A, a second strap 102B, a first wing 106A, and a second wing 106B. The first strap 102A is disposed between the first cup 104A and the first wing 106A. The second strap 102B is disposed between the second cup 104B and the second wing 106B. Further, the first cup 104A is separated from the second cup 104B via the resizable front gore component 112. The first wing 106A and the second wing 106B are brought and secured together (proximate a back of the user 118) via a fixation mechanism (not shown) when the double padded bra 100 is on and is being worn by the user 118 (of FIG. 2 and FIG. 3). In some examples, the first wing 106A and the second wing 106B are manufactured as one piece and as such, no such fixation mechanism is needed.

As shown in FIG. 1, the resizable front gore component 112 includes a first securement portion 110A, a second securement portion 110B, and a resizing component 114. In some examples, the resizing component 114 may comprise a slider or a similar component that allows for a length between the first cup 104A and the second cup 104B to be adjusted, and thus, an amount of cleavage of the user 118.

A first receiving portion 108A is affixed to an exterior side of the first cup 104A and a second receiving portion 108B is affixed to an exterior side of the second cup 104B. In some examples, each of the first receiving portion 108A and the second receiving portion 108B may comprise loops or openings and each of the first securement portion 110A and the second securement portion 110B of the resizable front gore component 112 may comprise hooks. In this example, the first receiving portion 108A may be configured to receive the first securement portion 110A and the second receiving portion 108B may be configured to receive the second securement portion 110B to affix the resizable front gore component 112 to the exterior of the first cup 104A and to the exterior of the second cup 104B, respectively.

However, it should be appreciated that though the configuration of each of the first securement portion 110A and the second securement portion 110B are depicted as loops or openings in FIG. 1, each of the first securement portion 110A and the second securement portion 110B are not limited to such configuration. It should further be appreciated that though the configuration of each of the first securement portion 110A and the second securement portion 110B of the resizable front gore component 112 are depicted as the hooks in FIG. 1, each of the first securement portion 110A and the second securement portion 110B are not limited to such. Such alternative configurations will be discussed herein. Moreover, in some embodiments, the first receiving portion 108A and the second receiving portion 108B may not be necessary and the resizable front gore component 112 may be affixed directly to the exterior of the first cup 104A and to the exterior of the second cup 104B via a fixation means, such as an adhesive, a hook-and-loop fastener, a sew-on fastener component, etc.

Based on the user's 118 desired level of cleavage, the user 118 may adjust the resizing component 114 of the resizable front gore component 112. FIG. 2 depicts an image of the double padded bra 100 prior to any adjustment of the resizing component 114. For example, and as shown in FIG. 3, if the user 118 desires more cleavage, the user 118 may adjust the resizing component 114 of the resizable front gore component 112 to reduce a length of the resizable front gore component 112, bringing together the first cup 104A and the second cup 104B as shown by the arrows. If the user 118 desires less cleavage, the user 118 may adjust the resizing component 114 of the resizable front gore component 112 to increase the length of the resizable front gore component 112 and the length between the first cup 104A and the second cup 104B.

It should be appreciated that there is no requirement that the first receiving portion 108A, the second receiving portion 108B, the first securement portion 110A and the second securement portion 110B be distinct components. In some examples, a single element may function to secure the resizable front gore component 112 between the first cup 104A and the second cup 104B. Moreover, in some examples, the resizable front gore component 112 may be manufactured directly on the exterior of the first cup 104A and on the exterior of the second cup 104B.

In other alternative examples, the resizable front gore component 112 may comprise a string or piece of fabric that is looped through the first receiving portion 108A and the second receiving portion 108B (having the loop or opening configuration), respectively, and tied upon the user 118 determining a desired length of the resizable front gore component 112 between the first cup 104A and the second cup 104B.

In another alternative example, each of the first cup 104A and the second cup 104B may comprise a plurality of openings at a first upper cup area 116A of the first cup 104A and a second upper cup area 116B of the second cup 104B, respectively. In this configuration, the resizable front gore component 112 may comprise the string or the piece of fabric, which may be woven through the plurality of openings at the first upper cup area 116A of the first cup 104A and the second upper cup area 116B of the second cup 104B. Once the user 118 has achieved a desired level of cleavage, the user 118 may tie or secure the string or the piece of fabric so as to maintain a length of the resizable front gore component 112. In an alternative embodiment, the bra can be worn as outwear or active wear such as a swimsuit.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein.

When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A double padded bra comprising:

a first cup affixed between a first strap and a first wing, the first cup having a first receiving portion;

a second cup affixed between a second strap and a second wing, wherein the first wing is affixed to the second wing via a fixation mechanism, the second cup having a second receiving portion; and a resizable front gore component disposed between the first cup and the second cup, the resizable front gore component comprising:

a first securement portion being a first G-hook with a first opening and a first protruding structure, the first protruding structure of the first G-hook is retained by an opening of the first receiving portion of the first cup;

a second securement portion being a second G-hook with a second opening and a second protruding structure, the second protruding structure of the second G-hook is retained by an opening of the second receiving portion of the second cup;

a length of material disposed between the first G-hook and the second G-hook, the length of material is configured to lengthen or reduce a distance between the first cup and the second cup to increase or decrease cleavage for a user wearing the double padded bra, a first end of the length of material is retained by the first opening of the first G-hook, a second end of the length of material is retained by the second opening of the second G-hook; and a resizing component configured to slidably traverse the length of material to adjust the distance between the first cup and the second cup, the resizing component being a slider comprising:

a plate with a first opening disposed adjacent to and in alignment with a second opening, the first opening of the plate and the second opening of the plate receive a portion of the length of material.

2. The double padded bra of claim 1, wherein each of the first cup and the second cup are padded.

3. The double padded bra of claim 1, wherein each of the first cup and the second cup are non-padded.

4. The double padded bra of claim 1, wherein the first receiving portion affixed to an exterior side of the first cup; and the second receiving portion affixed to an exterior side of the second cup.

5. The double padded bra of claim 4, wherein each of the first receiving portion and the second receiving portion comprise a loop or an opening, wherein the first receiving portion is configured to receive a first securement portion of the resizable front gore component, and wherein the second receiving portion is configured to receive a second securement portion of the resizable front gore component.

6. The double padded bra of claim 1, wherein the resizable front gore component is affixed directly to an exterior of the first cup and to the exterior of the second cup via a fixation means.

7. The double padded bra of claim 6, wherein the fixation means is selected from the group consisting of: an adhesive, a hook-and-loop fastener, and a sew-on fastener component.

8. The double padded bra of claim 1, wherein an upper cup area of the first cup and an upper cup area of the second cup comprises a plurality of openings.

9. The double padded bra of claim 8, wherein the resizable front gore component comprises a piece of fabric.

10. The double padded bra of claim 9, wherein the piece of fabric is woven through the plurality of openings and is secured when a user achieves a desired length of the resizable front gore component.

11. The double padded bra of claim 1, wherein the resizable front gore component comprises a piece of fabric that is configured to be looped through a first receiving portion affixed to an exterior side of the first cup and a second receiving portion affixed to an exterior side of the second cup and secured when a user achieves a desired length of the resizable front gore component.

* * * * *